US005484680A

United States Patent [19]

Goto et al.

[11] Patent Number: 5,484,680

[45] Date of Patent: Jan. 16, 1996

[54] MAGNETIC BRUSH DEVELOPING METHOD

[75] Inventors: Ryuji Goto, Fukaya; Koji Noguchi, Saitama, both of Japan

[73] Assignee: Hitachi Metals, Ltd.

[21] Appl. No.: 390,168

[22] Filed: Feb. 17, 1995

Related U.S. Application Data

[63] Continuation of Ser. No. 79,453, Jun. 21, 1993, abandoned, which is a continuation of Ser. No. 662,190, Feb. 28, 1991, abandoned.

[30] Foreign Application Priority Data

Feb. 28, 1990 [JP] Japan ..... 2-48823
Sep. 20, 1990 [JP] Japan ..... 2-251015

[51] Int. Cl.[6] ..... G03G 13/09

[52] U.S. Cl. ..... 430/122; 430/100

[58] Field of Search ..... 430/122, 100; 355/251, 253

[56] References Cited

U.S. PATENT DOCUMENTS 4,517,274 5/1985 Honda et al. .
4,640,880 2/1987 Kawanishi et al. .
4,841,332 6/1989 Haneda et al. ..... 430/122
5,049,471 9/1991 Higashiguchi et al. ..... 430/122
5,060,023 10/1991 Higashiguchi et al. ..... 355/251

*Primary Examiner*—Christopher D. Rodee
*Attorney, Agent, or Firm*—Finnegan, Henderson, Farabow, Garrett & Dunner

[57] ABSTRACT

The developing method of the present invention is carried out by providing a developing means comprising a non-magnetic sleeve and a permanent magnet member stationary inside the non-magnetic sleeve at a position opposing an image-bearing member having an electrostatic latent image on the surface, thereby forming a developing region; causing a developer to be magnetically attracted onto a surface of the non-magnetic sleeve, the developer comprising magnetic toner consisting of a binder resin and magnetic powder and capable of being charged at a particular polarity and a magnetic carrier having a relatively large conductivity; and rotating the non-magnetic sleeve to convey the developer to the developing region, thereby developing the electrostatic latent image with the magnetic toner. The non-magnetic sleeve is rotated in the same direction as the image-bearing member in the developing region at a ratio of a surface moving velocity ($V_1$) of the non-magnetic sleeve to a surface moving velocity ($V_2$) of the image-bearing member ($V_1/V_2$)=1.5–5.0. A center of a developing magnetic pole of the permanent magnet member is deviated by 2°–12° toward the downstream side from a line connecting the closest points of the non-magnetic sleeve and the image-bearing member.

4 Claims, 3 Drawing Sheets

MAGNETIC BRUSH DEVELOPING METHOD

This application is a continuation of application Ser. No. 08/079,453 filed Jun. 21, 1993, now abandoned, which is a continuation of application Ser. No. 07/662,190 filed Feb. 28, 1991, abandoned.

BACKGROUND OF THE INVENTION

The present invention relates to a developing method for visualizing an electrostatic latent image formed on an image-bearing member surface with a magnetic developer including magnetic toner in an electrophotographic method, an electrostatic recording method, an electrostatic printing method, etc.

In a typical electrophotographic method, an electrostatic latent image formed on a photosensitive drum surface is visualized with colored resin particles called toners, and the resulting toner image is fixed to a transfer sheet such as a plain paper by heating or pressurizing means to obtain a fixed image.

Various methods of developing such an electrostatic latent image have been proposed so far. Widely used among them is a method in which magnetic toner consisting of toner particles comprising a resin and magnetic powder is supplied onto a non-magnetic sleeve, to form a magnetic brush by a relative rotation of the sleeve and a permanent magnet member disposed inside the sleeve, and an image-bearing member surface is in slidable contact with this magnetic brush, thereby permitting the toner particles to attach to the electrostatic latent image. In this one-component magnetic toner system, a chargeable magnetic toner, which contains a charge-controlling agent so that the toner may be strongly charged in a particular (positive or negative) polarity, is used, and the development of an electrostatic latent image is carried out by utilizing a triboelectric charging phenomenon due to the contact of the toner particles with a sleeve or a doctor blade member.

However, when the chargeable magnetic toner is used alone, the toner particles are likely to be agglomerated by electric charging, so that streaks are formed on the image due to a shortage of toner on the sleeve. To obviate this problem, it has been proposed to use a developer comprising magnetic toner and magnetic carrier (U.S. Pat. Nos. 4,517,274 and 4,640,880).

In such a method of developing an electrostatic latent image by using a developer comprising a chargeable magnetic toner and a magnetic carrier, a magnetic carrier having a relatively high conductivity is used, and the toner concentration is not particularly controlled. Accordingly, the toner concentration is in a wide range of 10–90% in a developing region. Also, since the magnetic toner has an insulating property from the viewpoint of transferability, the electric resistance of the entire developer is extremely high. Thus, in order to obtain an image having a high image density and a good quality by using such a developer, efficient development of an electrostatic latent image is required. For this purpose, at least one of the non-magnetic sleeve and the magnet roll is usually rotated at a high speed to increase a speed of conveying the developer, thereby improving the development efficiency. However, when either one of the above members is rotated at a high speed, the developer is likely to be severely damaged, and large noises tend to be generated in the driving system.

BACKGROUND OF THE INVENTION

G,4

Accordingly, an object of the present invention is to provide a developing method capable of producing a good toner image even when a developer comprising a magnetic toner and a magnetic carrier is conveyed at a low speed.

To achieve the above object, the present invention provides a developing method comprising: providing a developing means comprising a non-magnetic sleeve and a permanent magnet member stationary inside the non-magnetic sleeve at a position opposing an image-bearing member having an electrostatic latent image on the surface, thereby forming a developing region; causing a developer to be magnetically attracted onto a surface of the non-magnetic sleeve, the developer comprising magnetic toner consisting of a binder resin and magnetic powder and capable of being charged at a particular polarity and a magnetic carrier having a relatively large conductivity; and rotating the non-magnetic sleeve to convey the developer to the developing region, thereby developing the electrostatic latent image with the magnetic toner, wherein (a) the non-magnetic sleeve is rotated in the same direction as the image-bearing member in the developing region at a ratio of a surface moving velocity ($V_1$) of the non-magnetic sleeve to a surface moving velocity ($V_2$) of the image-bearing member ($V_1/V_2$)=1.5–5.0, and (b) a center of a developing magnetic pole of the permanent magnet member is deviated by 2°–12° toward the downstream side from a line connecting the closest points of the non-magnetic sleeve and the image-bearing member.

According to the present invention, since the non-magnetic sleeve and the image-bearing member are rotated at a particular velocity ratio, and since the developing magnetic pole of the permanent magnet member stationary inside the non-magnetic sleeve is located at a position slightly deviated from the line connecting the closest positions of the non-magnetic sleeve and the image-bearing member, a high-quality image can be obtained. Also, since the non-magnetic sleeve supporting the developer is rotated at a relatively low speed to convey the developer into a developing region, noise reduction can be achieved.

DETAILED DESCRIPTION OF THE INVENTION

Figure 1:
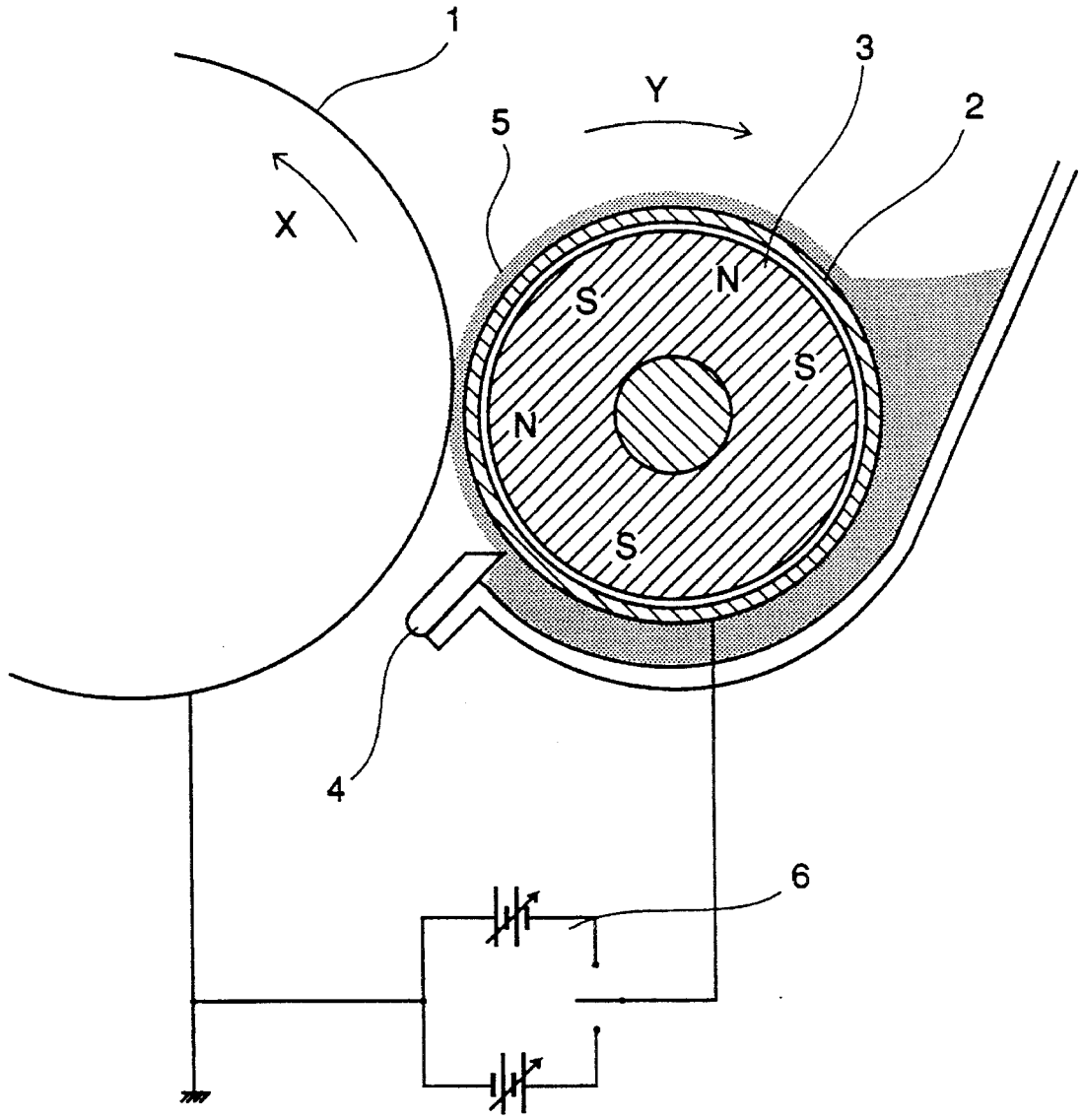
FIG. 1 is a schematic cross-sectional view showing an apparatus for measuring the chargeability of magnetic toner used in the present invention.

The present invention will be explained in detail referring to the drawings attached hereto.

The magnetic toner capable of being charged in a particular (positive or negative) polarity, which may be used in the present invention, can be measured with respect to its property by means of an apparatus shown in FIG. 1. This apparatus comprises a metal drum 1, a cylindrical sleeve 2 made of a non-magnetic metal material positioned in the vicinity of the metal drum 1, a magnet roll 3 fixedly positioned inside the cylindrical sleeve 2, a doctor member 4 disposed close to a surface of the cylindrical sleeve 2 for regulating the thickness of the magnetic toner 5 on the sleeve 2, and a voltage source 6 connected between the metal drum 1 and the sleeve 2. In FIG. 1, X and Y respectively show the rotation directions of the metal drum 1 and the sleeve 2.

Figure 2:
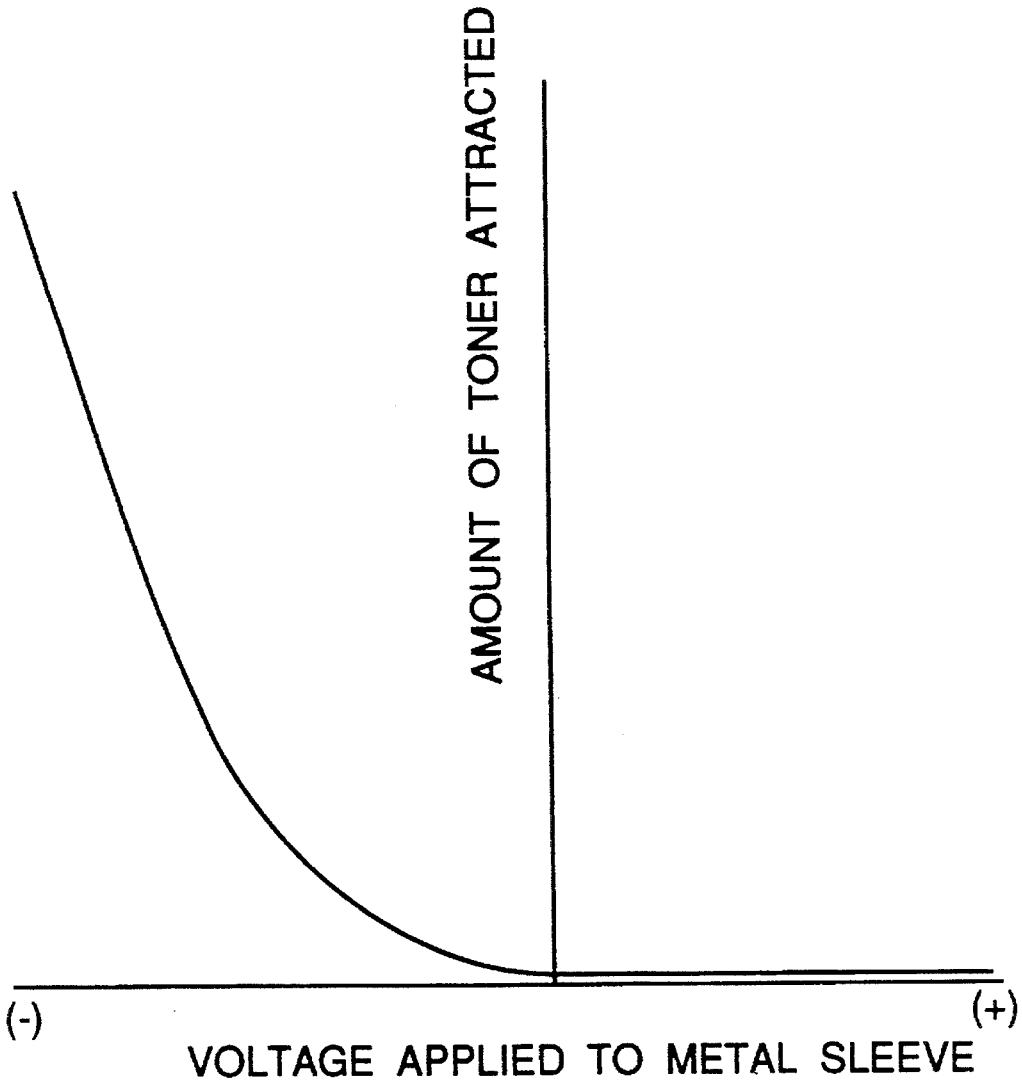
FIG. 2 is a graph showing the charging property of magnetic toner measured by the apparatus shown in FIG. 1.

In the above apparatus, when a DC bias voltage is applied from the voltage source 6 to the sleeve 2, the amount of the magnetic toner 5 attracted onto the metal drum 1 is changed. FIG. 2 shows the amount of the magnetic toner having a negative charging polarity. It shows that when the bias voltage is negative, more magnetic toner 5 is attracted onto the surface of the metal drum 1, and that when the bias voltage is positive, only a small amount of the magnetic toner 5 is attracted onto the metal drum surface even though current flow is detected.

Here, it is considered that the attraction of toner particles constituting the magnetic toner to the metal surface depends on the interaction between the toner particles and the mirror image formed on the metal surface by the charges possessed by the toner particles. An electric field formed between the charged toner particles attracted onto the metal surface and their mirror images tends to neutralize the charges of the toner particles, but the toner charge remains against this neutralization force. On the other hand, the charge having the opposite polarity is easily neutralized by an electric field formed between the toner particles and the mirror image, so that the attraction of the magnetic toner onto a sleeve is reduced to zero. Such a phenomenon is different depending upon whether the magnetic toner can keep a positive or a negative charge. In other words, depending upon the polarity of the charge, a potential barrier to the conductive surface largely differs. This is an important factor to the image formation by electrophotography. Namely, the developability extremely differs depending upon the positive or negative potential to the photosensitive drum.

As mentioned above, the present invention uses the magnetic toner capable of being charged in a particular polarity. Such a magnetic toner will be explained in detail below with respect to its materials and properties.

Although this magnetic toner can develop the electrostatic latent image well, the toner tends to remain on a surface of the developer-supporting member (non-magnetic sleeve) or is likely to be agglomerated when used alone because the electric charge is not easily removed from the magnetic toner. Accordingly, in the present invention, the magnetic toner is mixed with a magnetic carrier having a relatively high conductivity, to obviate the above problem. As a result, the formation of image is stable for a long period of time.

Next, one embodiment of the present invention will be explained referring to the drawings.

Figure 3:
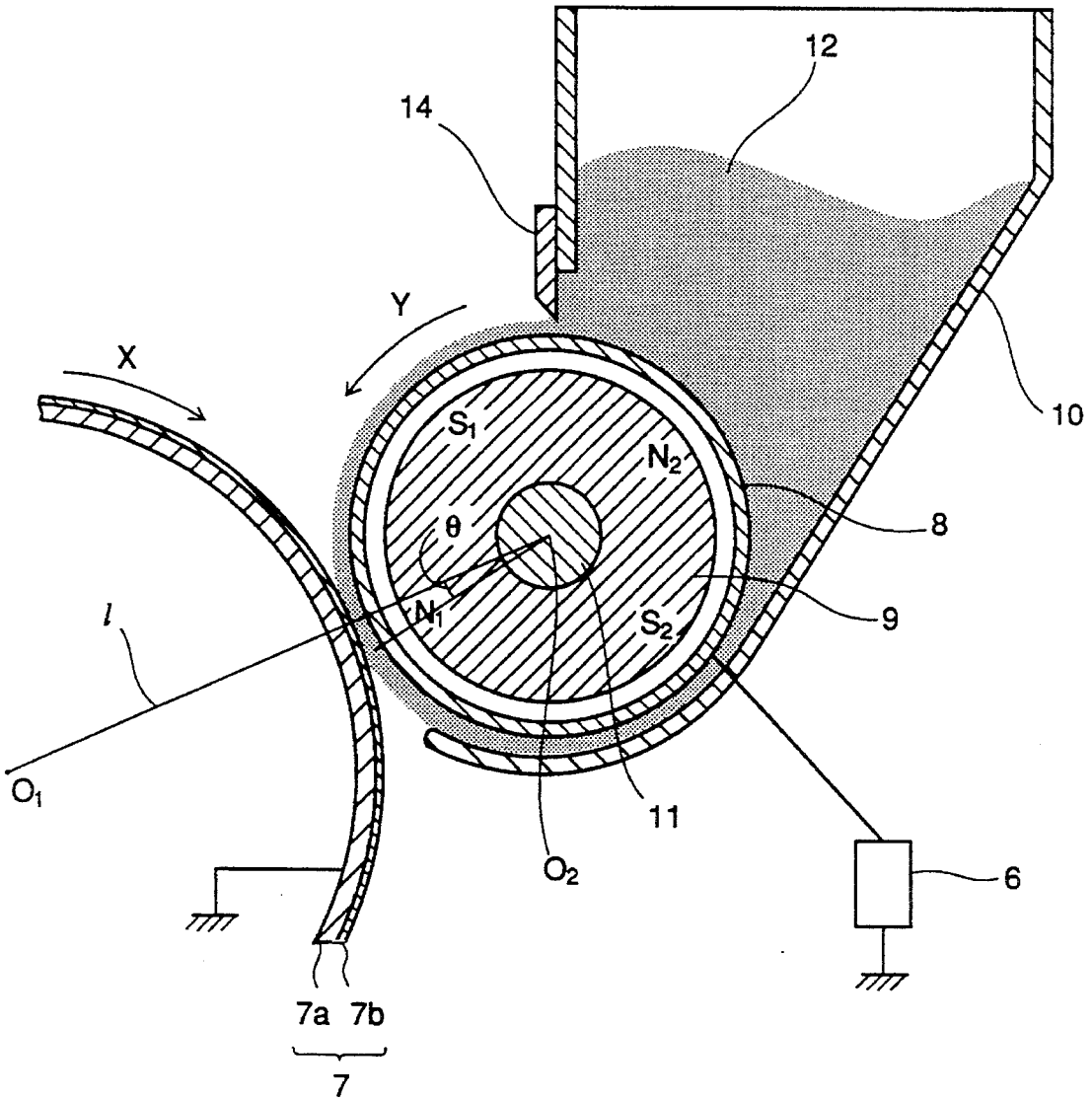
FIG. 3 is a schematic cross-sectional view showing a typical example of a developing apparatus usable for carrying out the developing method of the present invention.

FIG. 3 shows a typical example of a developing apparatus used in the present invention. In FIG. 3, 7 denotes an image-bearing member, which comprises a conductive substrate *7a* and a photosensitive layer *7b* formed on the substrate *7a*. The image-bearing member 7 rotates in a direction shown by the arrow X and is provided with an electrostatic latent image (not shown) by charging and exposure on the surface. 8 denotes a non-magnetic sleeve positioned opposite to the image-bearing member 7, so that the developing region Z is defined between the image-beating member 7 and the non-magnetic sleeve 8. 9 denotes a permanent magnet roll stationary inside the sleeve 8. The permanent magnet roll 9 has a plurality of magnetic poles on the surface, and is supported by a shaft 11. One of the magnetic poles of the permanent magnet member 9 (shown by $N_1$ in the figure) is called a developing magnetic pole which is located in a developing region Z. The other magnetic poles ($N_2$, $S_1$, $S_2$) are those for conveying the developer 12 comprising a magnetic carrier and a magnetic toner to the developing region Z. This developer 12 is contained in a developer container 10. The magnetic toner is supplied from a toner cartridge (not shown) provided in an upper portion of the developer container 10. 14 denotes a doctor blade fixed to the developer container 10 at such a position that there is a gap between the doctor blade 14 and the sleeve 8 for regulating the thickness of the developer 12 conveyed on the sleeve 8 into the developing region Z.

In the above developing apparatus, the developer 12 attracted onto the sleeve 8 is conveyed in a direction shown by the arrow Y by rotating the sleeve 8 by a proper driving means (not shown). When the developer 12 whose thickness on the sleeve 8 is regulated by the doctor blade 14 reaches the developing region Z, it is formed into a magnetic brush which is in slide contact with the surface of the image-bearing member 7, to conduct the development of the electrostatic latent image.

As a result of investigating various factors affecting the image quality in the magnetic brush method in which the sleeve is rotated, the inventors have found that high-quality image can be obtained by satisfying the following conditions.

The most important condition for achieving high-quality image is that the non-magnetic sleeve 8 is rotated in the same direction as the image-bearing member 7 in the developing region Z at a ratio of a surface moving velocity ($V_1$) of the non-magnetic sleeve 8 to a surface moving velocity ($V_2$) of the image-bearing member 7 ($V_1/V_2$)= 1.5–5.0. Namely, when the magnetic brush is in slide contact with the image-bearing member 7, it is important from the aspect of the image quality that a tip portion of the magnetic brush softly and uniformly slides over the surface of the image-bearing member 7. For this purpose, in the present invention, the sleeve 8 is rotated in the same direction as that of the image-bearing member 7 in the developing region Z. Also, when the conveying speed of the developer is small, the amount of the developer conveyed into the developing region Z is small, leading to the decrease of the image density and the phenomenon of fogging. Thus, to obtain a high-density image free from fogging, the velocity ratio $V_1/V_2$ is restricted to 1.5 or more. On the other hand, when the conveying speed of the developer is too large, toner is likely to be damaged and scattered. Thus, $V_1/V_2$ should be 5.0 or less. The preferred velocity ratio $V_1/V_2$ is 3–4.

Next, to achieve the high-quality image, it is also important that an unnecessary force is not applied to the magnetic brush in the developing region Z. for this purpose, it is conventionally designed that a peak of a magnetic field in the developing magnetic pole $N_1$ is located on a line connecting the closest points of the image-bearing member 7 and the sleeve 8 (on the line l connecting the centers $O_1$, $O_2$ in FIG. 3). In other words, the center of the $N_1$ pole is conventionally positioned on the line l. However, the inventors have found that high-quality image can be obtained when the center of the developing magnetic pole $N_1$ is deviated by an angle θ toward the downstream side from the above closest position when the developer comprising the magnetic toner and the magnetic carder is used. This angle θ should be 2°–12° for the reasons below.

When the angle θ is within the above range, the magnetic brush is in contact with the image-bearing member 7 at an acute angle. Since the magnetic brush rotates faster than the image-bearing member 7, the magnetic brush is in slide contact with the surface of the image-bearing member 7 as if it is brooming the image-bearing member surface. Conversely, when the angle θ exists on the upstream side relative to the rotation direction of the sleeve 8, the magnetic brush is at an obtuse angle to the surface of the image-bearing member 7. As a result, the magnetic brush is in contact with the image-bearing member 7 as if it is pushing the surface of the image-bearing member 7. Thus, a pushing force is applied to the magnetic brush so that it has a deformed shape. As described above, the contact condition of the magnetic brush and the image-bearing member 7 in the developing region Z largely varies depending upon the deviation angle θ, and this contact condition greatly affects of the image quality and the reproducibility and resolution of thin lines. As a result of research, the inventors have found that when the deviation angle θ is 2° or more on the downstream side from the line connecting the closest points of the sleeve 8 and the image-bearing member 7, high-quality image can be obtained without scattering the toner. On the other hand, when the deviation angle θ exceeds 12°, it becomes difficult to keep the image density.

Further, the image quality changes depending upon the strength of the developing magnetic pole $N_1$. In the present invention, this developing magnetic pole $N_1$ has a magnetic flux density of 700–1200 G (on the surface of the sleeve 8, infra). When the developing magnetic pole $N_1$ has a magnetic flux density of less than 700 G, the magnetic carrier and the magnetic toner are easily scattered from the sleeve 8, so that it is likely that the magnetic carrier is attached to the surface of the image-bearing member 7, and that fogging is generated. This also leads to the deterioration of the image quality, particularly resolution. On the other hand, when the $N_1$ pole has a magnetic flux density larger than 1200 G, the magnetic toner is too strongly attracted to the sleeve 8, resulting in the decrease in the image density.

In the present invention, in addition to the above development conditions, the developer is constituted as follows to obtain a high-quality image.

The magnetic carrier usable in the present invention is produced from iron powder, iron oxide (for instance, magnetite), soft ferrite (for instance, Ni-Zn ferrite, Mn-Zn ferrite, Cu-Zn ferrite), etc. Among these materials, the ferrite carrier is particularly suitable because it is chemically stable, suffers from little change of electric resistivity and has a smaller apparent density. By evaluating the properties of the magnetic carrier, it has been found that not only its electric and magnetic properties but also its particle size largely affect the image quality. In the present invention, the magnetic carrier of course has a particle size larger than that of the toner. It is necessary that most of the magnetic carrier is within the range of 20–105 μm, and more specifically that those less than 20 μm or exceeding 105 μm should be less than 5% by weight. When the carrier particles less than 20 μm are 5% or more, the magnetic carrier is likely to attach to the surface of the image-bearing member. On the other hand, when those exceeding 105 μm are 5% or more, the surface of the photosensitive drum tends to be damaged. The preferred particle size of the magnetic carrier is 37–74 μm. Incidentally, an average particle size of the magnetic carrier according to the present invention is desirably 50–70 μm.

With respect to the other properties, a saturation magnetization ($\sigma_s$) and an electric resistivity are important. In the present invention, the saturation magnetization is desirably 30–80 emu/g. When it is smaller than 30 emu/g, the magnetic carrier is likely to attach to the surface of the photosensitive drum, and when it exceeds 80 emu/g, the developability becomes poor. The more preferred saturation magnetization of the magnetic carrier is 55–75 emu/g. The electric resistivity of the magnetic carrier is preferably $10^5$–$10^{10}$ Ω·cm (measured in a DC electric field of 200 V/cm). When it is too large, electric charge is likely to be stored in the magnetic carrier, resulting in poor development. On the other hand, when it is too low, breakdown easily takes place at a low voltage. The more preferred electric resistivity of the magnetic carrier is $10^7$–$10^9$ Ω·cm.

With respect to the magnetic toner, it consists of toner particles comprising a binder resin and magnetic powder. The binder resin is selected depending upon the fixing method. For instance, in the case of a heat-fixing method, styrene resins, polyester resins, epoxy resins or these mixtures are preferable. The magnetic powder may be ferromagnetic metals such as iron, cobalt, nickel, etc. or their alloys or compounds containing these elements such as magnetite, etc. From the aspect of color and magnetic properties, magnetite is suitable. The amount of the magnetic powder should be 50 weight % or less. When the amount of the magnetic powder is too large, the toner cannot keep its electric charge and is less attracted onto the sleeve, so that it is difficult for the magnetic toner to have a chargeability in a particular polarity. Incidentally, when the amount of the magnetic powder is too small, the magnetic toner is likely to be scattered. Accordingly, the lower limit of the magnetic powder is 10% or more. In this case, it is preferable that the magnetic toner has a saturation magnetization of about 8–41 emu/g when a usual magnetite is used.

In the present invention, in addition to the above indispensable components, the magnetic toner desirably contains a charge-controlling agent such as nigrosine die or azo die containing metal, etc. for having a large chargeability in a particular polarity. Further, fluidity improvers (such as silica, alumina, etc.) and resistance-adjusting agents (such as carbon black, etc.) may be added.

The magnetic toner of the present invention can be prepared by known methods such as a pulverization method, a spray-drying method, or a polymerization method. The preferred properties of the magnetic toner used in the present invention are as follows. The particle size distribution is within the range of 5–20 μm, preferably 6–16 μm. Incidentally, when there are a lot of toner particles having a particle size of 8 μm or less, the fogging tends to be generated. Accordingly, toner particles having a particle size of 8 μm or less are preferably 20 weight % or less based on the total weight of the magnetic toner. The specific resistivity of the magnetic toner is $10^{14}$ Ω·cm or more (measured in a DC electric field of 4 kV/cm) from the aspect of transferability.

The developer of the present invention is prepared from the above magnetic carrier and magnetic toner. The amount of the magnetic toner in the developer (toner concentration) may be as wide as 10–90% by weight. The preferred toner concentration is 20–60%. The amount of the magnetic carrier may vary depending upon the materials of the carrier and the size of the developing apparatus. In the case of the ferrite carrier, its amount is preferably 0.05–1 g/cm$^2$ per a unit area of the sleeve.

Apart from the above conditions, the desired development conditions for carrying out the present invention are as follows: With respect to the surface potential of the photosensitive materials used, which may vary depending upon the types of the photosensitive materials used, it is preferably 400–700 V in an absolute value. Also, in the case of the reverse development of the electrostatic latent image on the organic photosensitive drum, a bias voltage 0.6–0.9 times as large as the surface potential in the same polarity is applied to the sleeve to obtain a high-density image without fogging. With a development gap of 0.2–0.6 mm, good contact between the magnetic brush and the photosensitive drum can be obtained. The doctor gap may be the same or slightly smaller than the developing gap.

Incidentally, in the present invention, the magnetic properties of the magnetic carrier and the magnetic toner are measured in a magnetic field (maximum: 10 kOe) by a vibrating sample magnetometer (Model VSM-3, manufactured by Toei Industry Co., Ltd.).

EXAMPLE 1

60 parts by weight of a styrene-n-butyl methacrylate copolymer (Mw: about 200,000, Mn: about 10,000), 38 parts by weight of magnetite (EPT-500, manufactured by Toda Kogyo Corporation) and 2 parts by weight of a Cr-containing azo die (BONTRON E81 manufactured by Orient Chemical Industries, Ltd.) were dry-mixed and melt-blended. After cooling and solidifying, the resulting blend was pulverized and classified to obtain magnetic toner having an average particle size of 11 μm. This magnetic toner was mixed with ferrite carrier having an electric resistivity of $10^8$ Ω·cm and a particle size of 37–74 μm (KBN-100 manufactured by Hitachi Metals, Ltd.) to prepare a developer having a toner concentration of 50%.

With the above developer, an image was produced under the following conditions. In FIG. 3, the image-bearing member 7 was an organic photosensitive drum (outer diameter: 40 mm), and this drum was rotated at a peripheral speed of 60 mm/sec. The sleeve 8 was produced from a SUS304 cylinder having an outer diameter of 24 mm, and a cylindrical magnet having 4 magnetic poles ($N_1$=900 G) was fixed to a shaft inside the sleeve 8 such that the deviation angle θ was 8°. The developing gap and the doctor gap were 0.35 mm and 0.32 mm, respectively. The photosensitive drum was charged such that its surface potential (charged portion) was −550 V and its residual potential (exposed portion) was −50 V, and a dc bias voltage of −400 V was applied to the sleeve 8 to carry out reverse development. Next, the developed toner image was transferred to a plain paper, and fixed by a heat roller (fixing temperature: 180° C., fixing pressure: 1 kg/cm, nip width: 4 mm).

In the above operation, with various rpms and rotation directions of the sleeve, the resulting images were evaluated. The results are shown in Table 1.

TABLE 1

| Sample No. | Velocity Ratio | Moving Direction of Sleeve* | Image Density | Fogging | Toner Scattering |
|---|---|---|---|---|---|
| 1-1 | 1.2 | Same | 0.95 | Poor | Good |
| 1-2 | 2.1 | Same | 1.41 | Good | Good |
| 1-3 | 3.0 | Same | 1.44 | Good | Good |
| 1-4 | 4.2 | Same | 1.46 | Good | Good |
| 1-5 | 4.8 | Same | 1.46 | Good | Slightly Poor |
| 1-6 | 2.1 | Opposite | 1.44 | Slightly Poor | Good |

TABLE 1-continued

| Sample No. | Velocity Ratio | Moving Direction of Sleeve* | Image Density | Fogging | Toner Scattering |
|---|---|---|---|---|---|

Note
*"Same" means that the moving direction of the sleeve is the same as that of the photosensitive drum in the developing region, and "opposite" means that the moving direction of the sleeve is opposite to that of the photosensitive drum in the developing region.

It is clear from the results shown in Table 1 that when the velocity ratio of the sleeve is 2.1–4.8, high-quality images are obtained. When the velocity ratio of the sleeve is 1.2, the image density is low and the fogging is increased. Incidentally, when the velocity ratio of the sleeve is more than 5.0, there is substantial toner scattering. Accordingly, the velocity ratio of the sleeve should be 5.0 or less. When the sleeve is rotated in an opposite direction, the fogging is likely to take place. In addition, black areas in the resulting image do not sharp edges. By considering the image quality, the toner scattering, the damaging of the developer, and the noise of the driving apparatus, it has been found that the preferred range of the velocity ratio of the sleeve is 1.5–5.0, more preferably 3–4.

EXAMPLE 2

Example 1 was repeated except for changing the velocity ratio of the sleeve relative to the image-bearing member to 2.1 at a deviation angle θ of −2° to 14°. The results are shown in Table 2.

TABLE 2

| Sample No. | θ(°) | Image Density | Resolution | Spreadness of Toner |
|---|---|---|---|---|
| 2-1 | 0 | 1.45 | Poor | Poor |
| 2-2 | 2 | 1.44 | Fair | Fair |
| 2-3 | 4 | 1.42 | Good | Good |
| 2-4 | 8 | 1.41 | Excellent | Excellent |
| 2-5 | 12 | 1.33 | Good | Good |
| 2-6 | 14 | 1.27 | Good | Good |
| 2-7 | −2 | 1.45 | Poor | Poor |

It is clear from the results shown in Table 2 that when θ is 2°–12°, a high-quality image can be obtained, but that when θ is 0° or −2°, the resolution is reduced and the spreadness of toner takes place. When θ is 14°, the image density is slightly low.

EXAMPLE 3

Example 1 was repeated under the same conditions except for changing the velocity ratio of the sleeve relative to the image-bearing member to 2.1 and the particle size distribution of the magnetic carrier to various ranges. The results are shown in Table 3.

TABLE 3

| Sample No. | Particle Size Distribution of Carrier (μm) | Image Density | Fogging* | Attaching of Carrier to Photo-Sensitive Drum |
|---|---|---|---|---|
| 3-1 | 37–74 | 1.42 | Good | None |
| 3-2 | 37–105 | 1.41 | Good | None |
| 3-3 | 74–149 | 1.38 | Poor | None |
| 3-4 | 74–105 | 1.36 | Poor | None |

TABLE 3-continued

| Sample No. | Particle Size Distribution of Carrier (μm) | Image Density | Fogging* | Attaching of Carrier to Photo-Sensitive Drum |
|---|---|---|---|---|

Note
*"Good means that the ranges of the bias voltage applied to a sleeve and the surface potential of the photosensitive drum, which do not cause the fogging, are wide, and "poor" means that the above ranges are narrow.

As is clear from Table 3, when the particle size distribution of the magnetic carrier is within the range of the present invention (3-1 and 3-2), high-quality image can be obtained. On the other hand, when the particle size distribution of the magnetic carrier is outside the range of the present invention (3-3 and 3-4), the fogging is easily generated.

As described above in detail, according to the present invention, high-quality image without fogging can be obtained at a high density even at a low conveying speed of the developer. Since a developer-conveying means needs not be rotated at a high speed, a load to a driving system is reduced, and the noise of the driving system is drastically decreased. Further, since the developer is not subjected to a large load, a stable development can be achieved for a long period of time.

What is claimed is:

1. A magnetic brush developing method comprising: providing a developing means comprising a non-magnetic sleeve and a permanent magnet member stationary inside said non-magnetic sleeve at a position opposing an image-bearing member having an electrostatic latent image on the surface and forming a development gap therewith, thereby forming a developing region, said permanent magnet member having a developing magnetic pole in said developing region, and said developing magnetic pole providing a magnetic flux density of 700–1200 Gauss on the surface of said non-magnetic sleeve;

selecting a developer comprising magnetic toner consisting of a binder resin and magnetic powder and capable of being charged at a particular polarity, and a magnetic carrier having a conductivity corresponding to an electric resistivity of $10^5$– $10^{10}\Omega$-cm and a particle size distribution within the range of 20–105 μm, said magnetic toner containing 10–50 wt % of said magnetic powder, and said developer containing 10–90 wt % of said magnetic toner;

causing the developer to be magnetically attracted onto a surface of said non-magnetic sleeve to form a magnetic brush; and rotating said non-magnetic sleeve to convey said magnetic brush to said developing region for bringing a tip portion of said magnetic brush into sliding contact with said image bearing member in said developing region, thereby developing said electrostatic latent image with said magnetic toner, wherein (a) said non-magnetic sleeve is rotated in the same direction as said image-bearing member in said developing region at a ratio of a surface moving velocity ($V_1$) of said non-magnetic sleeve to a surface moving velocity ($V_2$) of said image-bearing member ($V_1/V_2$)= 1.5–5.0, (b) the center of the developing magnetic pole of said permanent magnet member is deviated by 2°–12° toward the downstream side from a line connecting the closest points of said non-magnetic sleeve and said image-bearing member, (c) the development gap between said non-magnetic sleeve and said image-bearing member is set to be 0.2–0.6 mm, and (d) said image-bearing member has a negatively charged organic photosensitive surface layer having a surface potential of –400 to –700 V.

2. The magnetic brush developing method according to claim 1, wherein a bias voltage 0.6–0.9 times as large as said surface potential is applied to said non-magnetic sleeve when said electrostatic latent image is reverse-developed.

3. The magnetic brush developing method according to claim 1, wherein said magnetic carrier is a ferrite carrier, and the amounts of said magnetic carrier is 0.05–1 g/cm$^2$ per a unit area of said non-magnetic sleeve.

4. The magnetic brush developing method as in claim 1, wherein the ratio $V_1/V_2$ is set to be 3.0–4.0.

* * * * *